United States Patent [19]

Mollica

[11] 4,098,300

[45] Jul. 4, 1978

[54] SHUTTLELESS LOOM WITH UNIDIRECTIONAL WEFT THREAD CARRIERS

[76] Inventor: Francesco Mollica, Via Cairoli, 5, Varese, Italy

[21] Appl. No.: 818,895

[22] Filed: Jul. 25, 1977

[30] Foreign Application Priority Data

Aug. 3, 1976 [IT] Italy ..... 25966 A/76

[51] Int. Cl.[2] ..... D03D 49/24

[52] U.S. Cl. ..... 139/437; 139/439; 139/443

[58] Field of Search ..... 139/429, 437, 438, 439, 139/443

[56] References Cited

U.S. PATENT DOCUMENTS

| | | | |
|---|---|---|---|
| 3,388,722 | 6/1968 | Sakamoto | 139/437 |
| 3,543,808 | 12/1970 | Moessinger | 139/443 |
| 3,593,752 | 7/1971 | Moessinger | 139/439 |
| 4,015,642 | 4/1977 | Mollica | 139/438 |

*Primary Examiner*—Henry S. Jaudon
*Attorney, Agent, or Firm*—Guido Modiano; Albert Josif

[57] ABSTRACT

A shuttleless loom of the type having unidirectional weft thread carriers, comprising a device for throwing at least one said carrier, the device including a guide defining a closed path one portion of which passes through the shed and another returns below the shed. The guide also includes two arcuate portions at opposite sides of the loom and a circular guide portion substantially tangent to the carrier throwing path. Within the circular guide portion there is rotatably arranged a flywheel provided with an entraining member for the carriers. There is further provided a door which is controlled to throw out of the circular guide portion the carriers after they have made at least one complete revolution within the circular guide portion. The carriers are of substantially cylindrical configuration and adapted to accommodate circumferentially the weft thread as positioned at the exit of the circular guide portion in a direction substantially perpendicular to the carrier axis. The device further includes gripping and cutting members for the weft thread located at the exit of the circular guide portion to hold the weft thread engaged on one side by the carrier at least for the whole time during which the carrier is moving through the shed and to cut the weft thread on the other side substantially when the carrier reaches the midpoint of the travel thereof through the shed.

7 Claims, 10 Drawing Figures

SHUTTLELESS LOOM WITH UNIDIRECTIONAL WEFT THREAD CARRIERS

BACKGROUND OF THE INVENTION

This invention relates to a shuttleless loom with unidirectional weft thread carriers.

In my application Ser. No. 660,748 (now U.S. Pat. No. 4,015,642) there is disclosed a shuttleless loom of the type having unidirectional weft thread carriers, comprising a throwing and recovering device for at least one of said carriers, wherein the device includes a guide for causing the carriers to move along a closed path one portion of which passes through the shed, the guide including a linear throw portion and a linear return portion and two arcuate portions connecting said linear portions at opposite sides of the loom. The device further comprises at at least one of said arcuate portions a circular guide portion substantially tangent to the linear return portion and to the linear throw portion, a flywheel rotatably arranged within the circular guide portion and defining the inner wall thereof, the flywheel being provided with entraining means for the carriers. The device further comprises means for causing the carriers to make at least one complete revolution within the circular guide portion and to be thrown out of the circular guide portion into the throw portion after at least one complete revolution within the circular guide portion.

In a loom having a throwing and recovering device so constructed, the carrier returns to the throwing area with almost all of its throwing energy, only a modest part of this energy being lost through friction and resistances, contrary to what occurs in prior art shuttleless looms, where the carrier, or carriers, is slowed down and stopped at the shed termination and once again thrown from a standstill. The retention of most of the throwing energy affords a lower energy consumption for each fresh throw as well as a higher carrier velocity, which additionally makes available a longer time lapse for reciprocating the sley, which is thus allowed to reciprocate at a lower rate to generate less vibration.

It has now be found that the results obtainable with the device mentioned above may be further improved, particularly concerning the losses through friction and resistances by the carrier in its movement.

SUMMARY OF THE INVENTION

It is an object of this invention to further improve the device of my U.S. Pat. No. 4,015,642, in particular to achieve an even better utilization of the throwing energy and still lower losses in the carrier movement, such as to further improve the loom economy characteristics.

This object is achieved by a loom with a carrier throwing and recovering device of the type disclosed in U.S. Pat. No. 4,015,642, wherein the loom comprises at least one substantially cylindrical carrier, movable along arcuate portions of the guide with its own axis substantially parallel to the axis of said arcuate portions and configurated to receive circumferentially the weft thread positioned at the throwing portion exit of the guide in a direction substantially perpendicular to the carrier axis, the loom further comprising gripping and cutting means for the weft thread arranged at the throwing area respectively at opposite parts of the throwing path to hold the weft thread engaged by the carrier at least at one side for the whole time during which the carrier moves through the shed and to cut the weft thread at the other side as the carrier reaches substantially the midpoint of its travel through the shed.

In a device so constructed, a remarkable reduction is obtained in the frictional losses during the carrier movement in the guide, in particular at the curving portions of the guide where the carrier is subjected to a high centrifugal force, that reduction resulting from the utilization of a cylindrical carrier having its axis parallel to that of the curving portions of the guide and being enabled to roll along the walls of that same guide with a minimum of friction. It follows therefrom that the energy to be supplied at each fresh throw is even less than in the device of the above mentioned U.S. patent. The rolling motion and rotation of the cylindrical carrier about its own axis may, moreover, be advantageously utilized to facilitate the unwinding of the weft thread from the feeding spool during insertion of the weft thread between the warp threads.

BRIEF DESCRIPTION OF THE DRAWINGS

Further features and advantages of the invention will become more apparent from the following description of a preferred but not exclusive embodiment of the invention, having exemplary value only and being illustrated in the accompanying drawings, where.

DESCRIPTION OF THE PREFERRED EMBODIMENTS

Figures 1, 2:
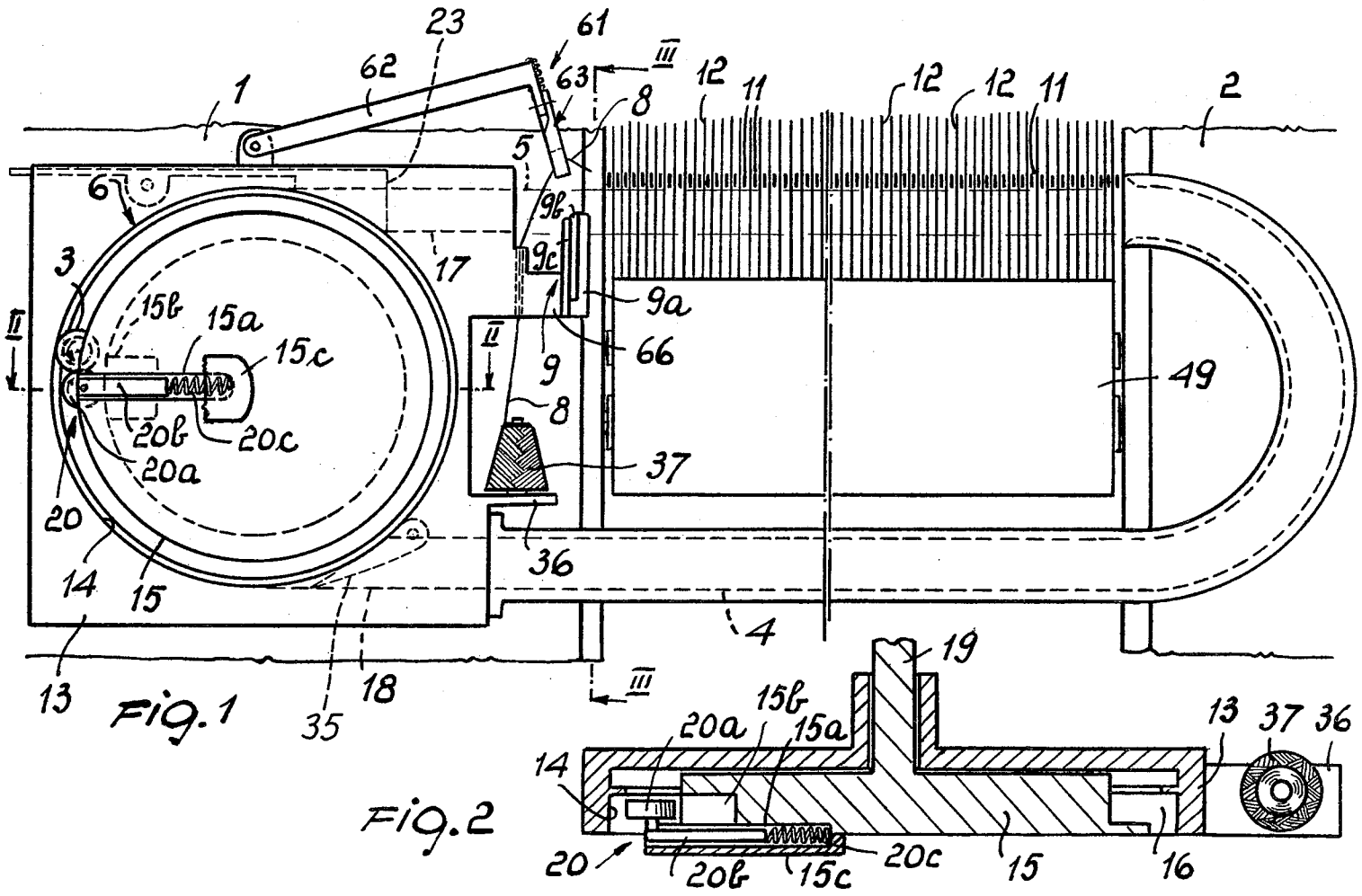
FIG. 1 is a schematic cross view of a loom and related carrier throwing and recovering device according to the invention.
FIG. 2 is a sectional view of the throwing assembly taken along the line II—II of FIG. 1, to a slightly enlarged scale.

In the description that follows, as well as in the drawings, those elements which happen to be similar or equivalent to the ones included in the device of my U.S. Pat. No. 4,015,642 have been denoted with the same reference numerals and will not be discussed in detail herein, but only very briefly so, as they are more amply illustrated and described in the said patent.

The numerals 1 and 2 denote two loom frames, wherebetween the guide 4 is arranged for the carrier (or carriers) 3, which is (are) thrown or shot along the throwing path 5 by the throwing assembly 6. The numeral 8 denotes the weft thread, 9 the cutting device, and 10 the sley, with the comb elements 11 inserted between the warp threads 12. Differently from the loom shown in my U.S. Pat. No. 4,015,642, a loom is exemplary considered here, wherein the fabric 49 is formed in a vertical plane rather than horizontal, whereafter it is wound around the reel 48.

In the structure 13 of the throwing assembly 6, a circular cavity or recess 14 is defined, wherein the flywheel 15 rotates, being so dimensioned as to define with the wall of the cavity 14 a circular guide 16, tangent to the throwing portion 17 and return portion 18 of the guide 4. The numeral 19 denotes the driveshaft of the flywheel 15, while 20 denotes the entraining and centrifuging means for the carrier 3, discussed in detail hereinafter.

At the connection areas between the portions 16 and 17, as well as 16 and 18, doors 23 and 35 are provided like in the device of U.S. Pat. No. 4,015,642. The timed activation of the throwing door 23 provided at the connecting area between the portions 16 and 17 may be of the type illustrated in said Patent.

According to the invention the carrier 3 is substantially cylindrical and has an outer diameter smaller than the height of the guide 4 and a thickness dimension slightly smaller than the width of that same guide. The carrier is movable in the circular guide 16 with its axis substantially parallel to the guide axis, thereby it is enabled to roll along the peripheral wall of the guide 16. The carrier is, moreover, shaped to accomodate the weft thread 8 circumferentially, and to this aim, it is suitably provided with a central peripheral groove 3*a*, wherein the thread is disposed in a manner that will be described hereinafter.

The entrainment means 20 for centrifuging the cylindrical carrier 3 and throwing the same comprises, of preference, a small wheel 20*a*, pivotally supported at the end of an arm 20*b*, which is guided in a geometrically mating relationship along a radial groove 15*a* in the flywheel 15 and urged by a spring 20*c* to a position such as to hold the wheel 20*a* normally within the circular guide 16. The groove 15*a* is covered with a plate 15*c* attached to the flywheel 15. A seat 15*b* is formed in the flywheel 15 adjacent to the groove 15*a* which is effective to retain the wheel 20*a* in the event of a collision with an arriving carrier at the junction area between the portions 18 and 16. By entraining the cylindrical carrier 3 through the wheel 20*a* friction is minimized, since a rolling contact becomes established between the contacting surfaces.

According to the invention there is provided, at the throwing area, a gripping means 61 for the weft thread 8, arranged to face the cutting means 9 on the opposite side with respect to the throwing path 5. According to the example shown, such gripping means 61 is external to the throwing path of the carrier 3 and comprises an arm 62 journaled to the structure 13 along an axis parallel to the rotation axis of the flywheel 15 and carrying at its free end a gripper 63, the elements whereof are journaled along an axis perpendicular to the pivot axis of the arm 62, and are held normally closed by a spring 64, extending between a projecting arm of one of the elements of the gripper 63 and a lug 65 on the arm 62. This is associated with drive means, not shown, operative to move it between a normal gripping position, such as shown in FIG. 1, and a thread catching position, such as shown with dotted lines in FIG. 7*c*. The plane of gripping contains the throwing path line 5.

The cutting device 9 comprises essentially a fixed blade 9*a*, attached to a bracket 66 of the structure 13, a movable blade 9*b*, of angular configuration and journaled to that same bracket with its axis parallel to the throwing path 5, and a fixed gripping element 9*c*, also attached to the bracket 66. The movable blade 9*b* is located between the fixed blade 9*a* and the gripping element 9*c*. The latter is at an advanced location with respect to the fixed blade 9*a* in the direction of movement of the movable blade 9*b* during the cutting step.

The weft thread 8 is supplied by a reel 37 carried by a support 36 connected to the structure 13 and located, with respect to the throwing path 5, on the same side as the cutting device 9. The thread 8 is fed through a guide 67 formed in the bracket 66 and arranged such that the thread emerging therefrom and gripped in the gripper 63 is positioned in front of the exit of the throwing path portion 17 and perpendicularly to the rotation axis of the carrier 3.

Figure 6A:
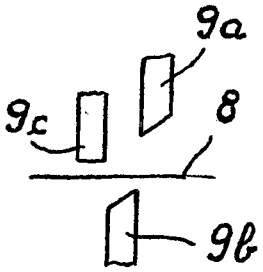
FIGS. 6*a* and 6*b* show schematically how the weft thread is cut.

For the description of the operation of the device according to the invention, reference will be made to FIGS. 6*a* and 6*b* as well as 7*a*, 7*b* and 7*c*.

The cylindrical carrier 3, being centrifuged in the throwing assembly 6 before being thrown out therefrom is suitably made to roll along the peripheral surface of the circular guide 16, thus presenting a minimal frictional resistance to the entrainment thereof by the entraining means 20, this frictional resistance being further reduced by virtue of the rolling engagement of the carrier on the wheel 20*a*.

Figure 3:
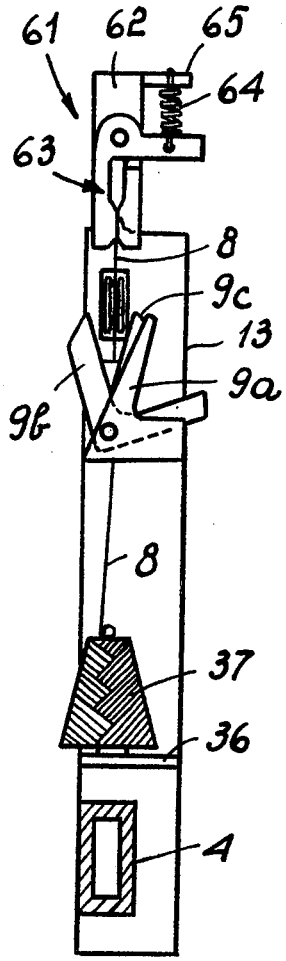
FIG. 3 is a sectional view of the throwing assembly and of the gripping and cutting means along the line III—III of FIG. 1, to a slightly enlarged scale.
Figure 4:
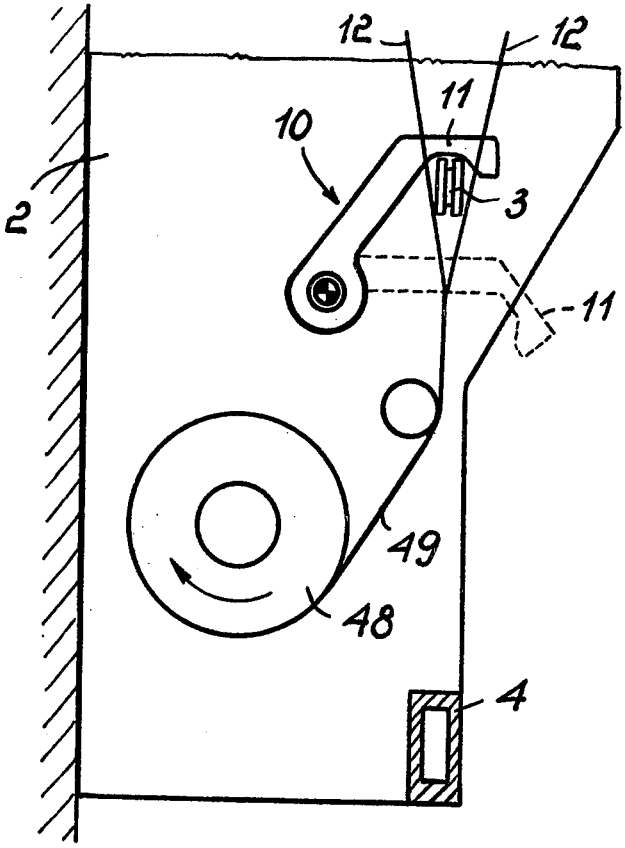
FIG. 4 is a schematic elevational view of the loom with the carrier passing through the shed.
Figure 5:
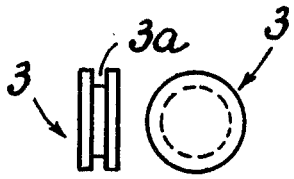
FIG. 5 shows the carrier, represented in a front and side view, according to a preferred embodiment thereof.
Figure 7A:
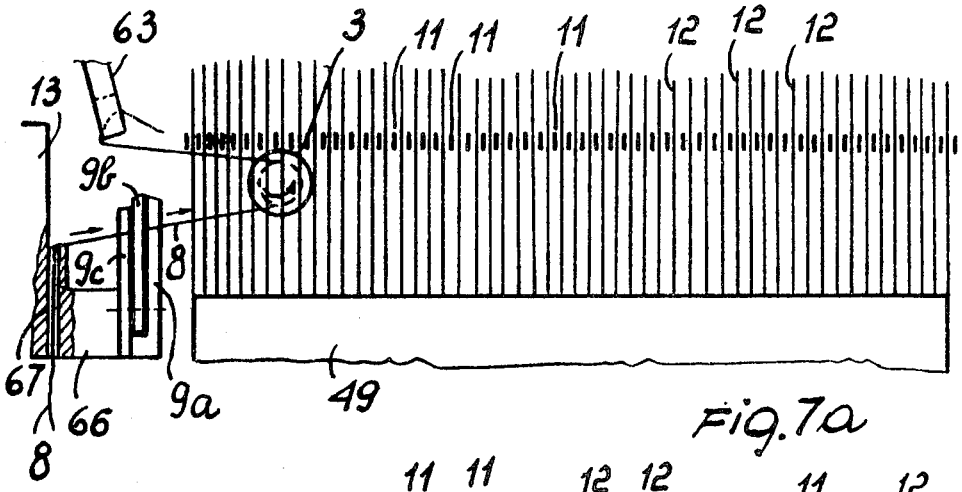
FIGS. 7*a*, 7*b* and 7*c* show three successive steps of the insertion of the weft thread between warp threads with the device according to the invention.

Once thrown, the carrier 3, still rotating about its own axis, meets the weft thread 8 stretched before the exit from the throwing portion 17, and after engaging it for a part of its circumference in the groove 3*a*, directs it to the shed inside, as shown in detail in FIG. 7*a*. The thread is gradually unwound from the reel 37 through the guide 67, while it is gripped at the opposite end. Most advantageously, the rotation of the carrier 3 facilitates the unwinding of the thread from the reel 37. During this operational step, the thread is enabled to pass freely between the fixed blade 9*a* and movable blade 9*b*, which are in their rest or non-operating position depicted in FIG. 3.

Figure 7B:
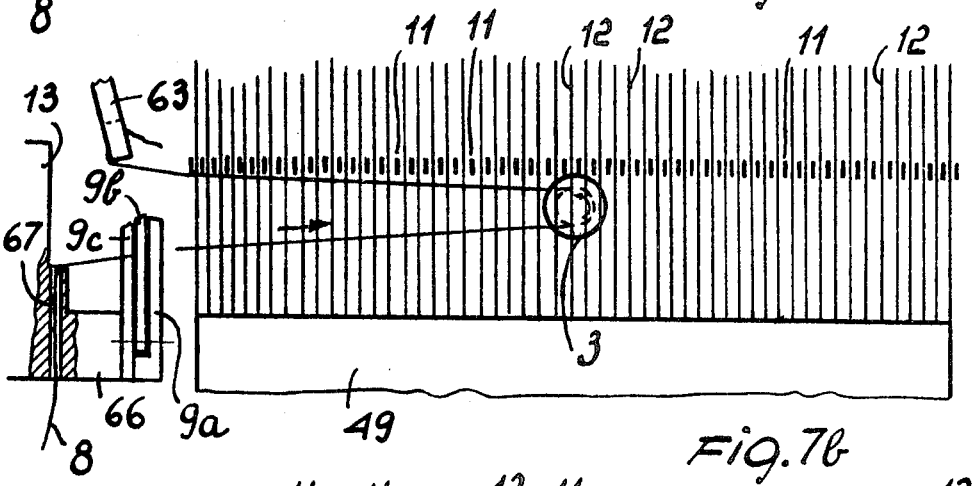

After the carrier 3 has covered a distance substantially equal to one half the cloth width, as shown in FIG. 7*b*, the movable blade 9*b* is controlled (e.g. by means of a mechanical control on the right angle projecting arm of the blade) to rapidly cut the thread while the opposite end of the thread is still gripped in the gripper 63.

Figure 6B:
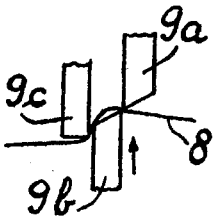

The cutting operation is depicted in FIG. 6*b*. This also involves an instantaneous or momentary pinching of the thread between the movable blade 96 and gripper element 9*c*, the facing surfaces whereof are either free from sharp corners or arranged at a distance apart such as to have no cutting effect.

Figure 7C:
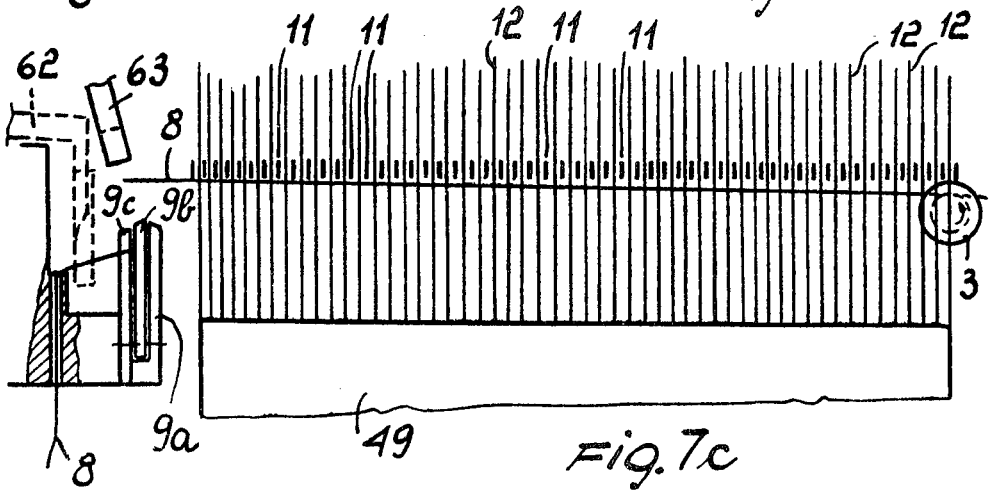

While the cut off length of thread which stays on the carrier side is now progressively re-drawn into the shed as the carrier advances, the thread length on the side of the reel 37 remains for the moment pinched between the movable blade 9*b* and gripping element 9*c*. On reaching the shed end, as shown in FIG. 7*c*, the carrier releases the weft thread 8, which remains inserted between the warp threads 12.

At this point, the end of the thread held in the gripper 63 is released and the just inserted thread is subjected to the forward moving action of the sley 10, in a conventional manner. The open gripper 63 is then brought to the position shown with dotted lines in FIG. 7*c*, to grip the fresh thread end held upstream of the cutting device 9 between the latter and the guide 67. The movable blade 9*b* is then controlled to move into the opened position, thus releasing the pinched thread, while the gripper 63, clamping on the thread, is returned to its normal operating position and a fresh insertion step or cycle may take place by means of that same carrier 3 once again brought to throwing speed in the assembly 6 or by means of another carrier 3 which has been accelerated in the meantime.

The means for sequentially controlling the opening of the two elements of the gripper 63, the lowering of the arm 62, the closing of the elements of the gripper 63, the releasing of the thread end pinched between the gripping element 9*c* and movable blade 9*b*, and the returning of the arm 62 to its normal operating position have not been shown, as they are easy to implement for the skilled expert and do not make part of this invention.

It will be observed that the cylindrical carrier 3, rolling along the walls of the guide 4, in particular at the curving sections thereof, is subjected to a minimal friction effect and during the insertion of the weft thread between the warp threads, by continuing in its rotation about its own axis in the same direction as the unwinding direction of the thread from the spool 37, advantageously facilitates the deposition of the weft thread between the warp threads.

The same warp threads as well as the comb elements 11 advantageously define a guide for the carrier and effectively prevent the latter from rotating about an axis coincident with the direction of advance thereof, i.e. from tilting or slanting, which would no longer allow for the entrance of the carrier into the guide 4 on completing the shed pass.

The invention lends itself to many variations and modifications, all within the scope of the appended claims. Thus, for example, a different gripping assembly or gripping and cutting assembly could be provided, with respect to the one shown, or it would be also possible to move the carrier 3 across the shed with its axis extending vertical rather than horizontal, i.e. parallel to the plane of the formed cloth, in which case the arrangements of the gripping and cutting assemblies at the throwing portion would be re-oriented accordingly. Finally, it would be possible to provide two circular guides 16 adjacent the structure 13, as shown in FIG. 9, one of the guides being a stand-by guide and the other an acceleration and throwing guide. The transferring from one guide to the other could be suitably effected by means of a switch similar to a railroad switch. The thread could be fed to the carrier with an intervening thread storage to prevent sudden stresses from being applied to the thread and carrier.

I claim:

1. A shuttleless loom of the type having unidirectional weft thread carriers, comprising a throwing and recovering device for at least one of said carriers, wherein said device includes a guide for causing said at least one of said carriers to move along a closed path one portion of which passes through the shed, said guide including a linear throw portion and a linear return portion and two arcuate portions connecting said linear portions at opposite sides of the loom, said device comprising at at least one of said arcuate portions a circular guide portion substantially tangent to said linear return portion and to said linear throw portion, a flywheel rotatably arranged within said circular guide portion and defining the inner wall thereof, said flywheel being provided with entraining means for said at least one of said carriers, and means for causing said at least one of said carriers to make at least one complete revolution within said circular guide portion and to be thrown out of said circular guide portion into said throw portion after said at least one complete revolution, wherein said loom comprises at least one substantially cylindrical weft thread carrier, movable in said arcuate portions with its own axis substantially parallel to the axes of said arcuate portions and adapted to accomodate circumferentially the weft thread as positioned at the exit of said throw portion of said guide in a direction substantially perpendicular to said carrier axis, said device including also gripping and cutting means for the weft thread located at said exit of said throw portion respectively on opposite sides with respect to the throwing path to hold the weft thread engaged on one side by said carrier at least for the whole time during which said carrier is moving through the shed and to cut the weft thread on the other side substantially when said carrier reaches the midpoint of the travel thereof through the shed.

2. A loom according to claim 1, characterized in that said at least one substantially cylindrical weft thread carrier has a central peripheral groove adapted for engagement with the weft thread.

3. A loom according to claim 1, characterized in that said gripping means are arranged outside of the carrier path, and in that said cutting means are arranged within said path, the weft thread being fed from the side of said cutting means.

4. A loom according to claim 1, characterized in that said entraining means comprise an arm supported by said flywheel and penetrating said annular guide portion and a wheel rotatably supported at the end of said arm.

5. A loom according to claim 4, chracterized in that said flywheel comprises a radial groove slidably housing said arm, and a spring for urging said arm to a position such as to hold said wheel within said annular guide portion, said flywheel including also a seat adjacent said groove and adapted to accommodate said wheel in the event of collision with an arriving carrier.

6. A loom according to claim 1, characterized in that said gripping means comprise a gripper movable in a plane containing the throwing path between two opposite positions with respect to said path, one being a weft thread holding position in front of the exit from said throw portion of said guide and the other being a weft thread catching position upstream of said cutting means.

7. A loom according to claim 1, characterized in that said cutting means comprise a fixed blade, a fixed gripping element and a movable blade arranged between said fixed blade and said fixed gripping element, said gripping element slightly leading with respect to said fixed blade in the direction of movement of said movable blade during the cutting operation.

* * * * *